US006394823B1

(12) United States Patent
Dunham et al.

(10) Patent No.: US 6,394,823 B1
(45) Date of Patent: May 28, 2002

(54) CONNECTOR WITH TERMINALS HAVING INCREASED CAPACITANCE

(75) Inventors: David E. Dunham, Aurora; Russell J. Leonard, Naperville, both of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/580,316

(22) Filed: May 26, 2000

(51) Int. Cl.[7] ..... H01R 4/66

(52) U.S. Cl. ..... 439/108; 439/637; 439/608; 439/60

(58) Field of Search ..... 439/108, 60, 637, 439/636, 634, 633, 941, 608

(56) References Cited

U.S. PATENT DOCUMENTS

| | | | | |
|---|---|---|---|---|
| 4,461,522 A | | 7/1984 | Bakermans et al. | |
| 4,687,267 A | | 8/1987 | Header et al. | |
| 4,715,820 A | | 12/1987 | Andrews, Jr. et al. | |
| 4,780,095 A | | 10/1988 | Classon et al. | |
| 4,996,766 A | | 3/1991 | Piorunneck et al. | |
| 5,004,430 A | | 4/1991 | DelGuidice et al. | |
| 5,071,371 A | | 12/1991 | Harwath et al. | |
| 5,077,893 A | | 1/1992 | Mosquera et al. | |
| 5,163,847 A | | 11/1992 | Regnier | 439/157 |
| 5,203,725 A | | 4/1993 | Brunker et al. | |
| 5,221,212 A | | 6/1993 | Davis | |
| 5,259,768 A | | 11/1993 | Brunker et al. | 439/60 |
| 5,309,630 A | | 5/1994 | Brunker et al. | 29/842 |
| 5,425,658 A | | 6/1995 | White | |
| 5,460,537 A | | 10/1995 | Noschese | |
| 5,496,180 A | * | 3/1996 | Fabian et al. | 439/60 |
| 5,522,737 A | * | 6/1996 | Brunker et al. | 439/637 |
| 5,526,071 A | | 6/1996 | Obara et al. | |
| 5,562,461 A | | 10/1996 | Obara et al. | |
| 5,580,257 A | | 12/1996 | Harwath | |
| 5,580,267 A | | 12/1996 | Stipanuk et al. | |
| 5,586,914 A | | 12/1996 | Foster, Jr. et al. | |
| 5,620,342 A | | 4/1997 | Kinross | |
| 5,725,389 A | | 3/1998 | Scheer | |
| 5,782,644 A | | 7/1998 | Kiat | |
| 5,791,925 A | | 8/1998 | Yu | |
| 5,882,211 A | | 3/1999 | Choy et al. | |
| 5,961,346 A | | 10/1999 | Choy | |

FOREIGN PATENT DOCUMENTS

| | | | |
|---|---|---|---|
| AU | 0 596 313 | 10/1993 | |
| EP | 333 837 | 8/1988 | |
| EP | 596 313 | 10/1993 | |
| EP | 651469 | 10/1994 | |
| EP | 0 651 470 A2 | 10/1994 | H01R/23/70 |
| EP | 0 752 741 A1 | 7/1996 | H01R/23/72 |
| JP | 1-206577 | 8/1989 | H01R/13/03 |
| JP | 7-58634 | 6/1995 | H01R/23/02 |

* cited by examiner

*Primary Examiner*—Tho D. Ta
*Assistant Examiner*—Phoung Chi Nguyen
(74) *Attorney, Agent, or Firm*—Thomas D. Paulius; Charles S. Cohen

(57) ABSTRACT

An edge card connector is provided for use with a circuit card having an edge and a plurality of contact pads near the edge. The connector includes a housing having an elongated slot for receiving the edge of the circuit card therein, along with terminal cavities adjacent to the slot. A plurality of terminals are inserted into the terminal cavities. At least some of the terminals each include a contact section extending into the slot for engaging a contact pad on the circuit card, along with an enlarged body section. A thin flexible contact arm extends between the body section and the contact section. A finger portion extends alongside the thin flexible contact arm to increase the capacitance of the terminal and, thereby, reduce the impedance of the circuit through the terminal.

21 Claims, 5 Drawing Sheets

CONNECTOR WITH TERMINALS HAVING INCREASED CAPACITANCE

FIELD OF THE INVENTION

This invention generally relates to the art of electrical connectors and, particularly, to a connector having terminals with increased capacitance for controlling the impedance in the connector.

BACKGROUND OF THE INVENTION

In today's high speed electronic equipment, it is desirable that all components of an interconnection path be optimized for signal transmission characteristics, otherwise the integrity of the system will be impaired or degraded. Such characteristics include risetime degradation or system bandwidth, crosstalk, impedance control and propagation delay. Ideally, an electrical connector would have little or no affect on the interconnection system regarding these characteristics. An ideal connector would be "transparent". In other words, the system would function as if circuitry ran through the interconnection and there would be no effect on the system whatsoever. However, such an ideal connector is impractical or impossible, and continuous efforts are made to develop electrical connectors which have as little effect on the system as possible.

Impedance and inductance control are concerns in designing an ideal connector. This is particularly true in electrical connectors for high speed electronic equipment, i.e., involving high frequencies. As example of such connectors is the popular type of electrical connector commonly called an "edge card" connector. An edge card connector is provided for receiving a printed circuit board or edge card having a mating edge and a plurality of contact pads adjacent the edge. Such edge connectors have an elongated housing defining an elongated receptacle or slot for receiving the mating edge of the printed circuit board. A plurality of terminals are spaced along one or both sides of the slot for engaging the contact pads adjacent the mating edge of the board. In many applications, such edge connectors are mounted on a second printed circuit board. The mating "edge" board commonly is called the "daughterboard", and the board to which the connector is mounted is called the "motherboard".

Another example of such connectors are board to board connectors in which a plug connector mounted on a board has an insertion portion with terminals thereon for insertion into a receptacle connector mounted on a board with terminals in a recess for receiving the insertion portion of the plug connector. The terminals in the plug connector mate with terminals in the receptacle connector to connect conductors on respective boards.

This invention is directed to an edge card connector wherein the terminals of the connector are structured to increase the capacitance thereof and, thereby, control the impedance of the connector. For instance, the connector may be interconnected in an electric circuit having a given impedance, and the terminals can be selected for tuning the connector to substantially match that impedance.

SUMMARY OF THE INVENTION

An object, therefore, of the invention is to provide a connector of the character described, with improved terminal structures for increasing the capacitance of the connector.

The connector is provided for use with a circuit component such as a card having an edge and a plurality of contact pads near the edge. A connector housing includes an elongated slot for receiving the edge of the circuit card therein and terminal cavities adjacent to the slot. A plurality of terminals are inserted into the terminal cavities. At least some of the terminals each includes a contact section extending into the slot for engaging a contact pad on the circuit card, along with an enlarged body section. A thin flexible contact arm extends between the body section and the contact section. A finger portion extends alongside the thin flexible contact arm to increase the capacitance of the terminal and, thereby, reduce the impedance of the circuit through the terminal.

In one embodiment of the invention, the finger portion is cantilevered alongside the thin flexible contact arm from a base of the finger portion integral with the arm. In another embodiment, the finger portion is cantilevered alongside the contact arm from a base of the finger portion integral with the contact section. In a further embodiment, the finger portion is integral with the contact arm at a point intermediate opposite ends of the finger portion, whereby the finger portion extends alongside the contact arm in opposite directions from that point.

The invention contemplates that at least one of the finger portions may be disposed on each of two opposite sides of the contact arm. A plurality of the finger portions may be disposed on one side of the contact arm. A plurality of the finger portions may be disposed on each of two opposite sides of the contact arm.

The invention also contemplates application to board to board connectors.

Other features of the terminal include a retention section projecting from the body section into a retention cavity in the housing. A tail section projects from the body section out of the housing for connection to an appropriate circuit trace on a printed circuit board. In the preferred embodiment of the invention, the aforementioned plurality of terminals are signal terminals which alternate along the slot with a plurality of ground terminals which also include finger portions facing the finger portions of the signal terminals longitudinally of the slot.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
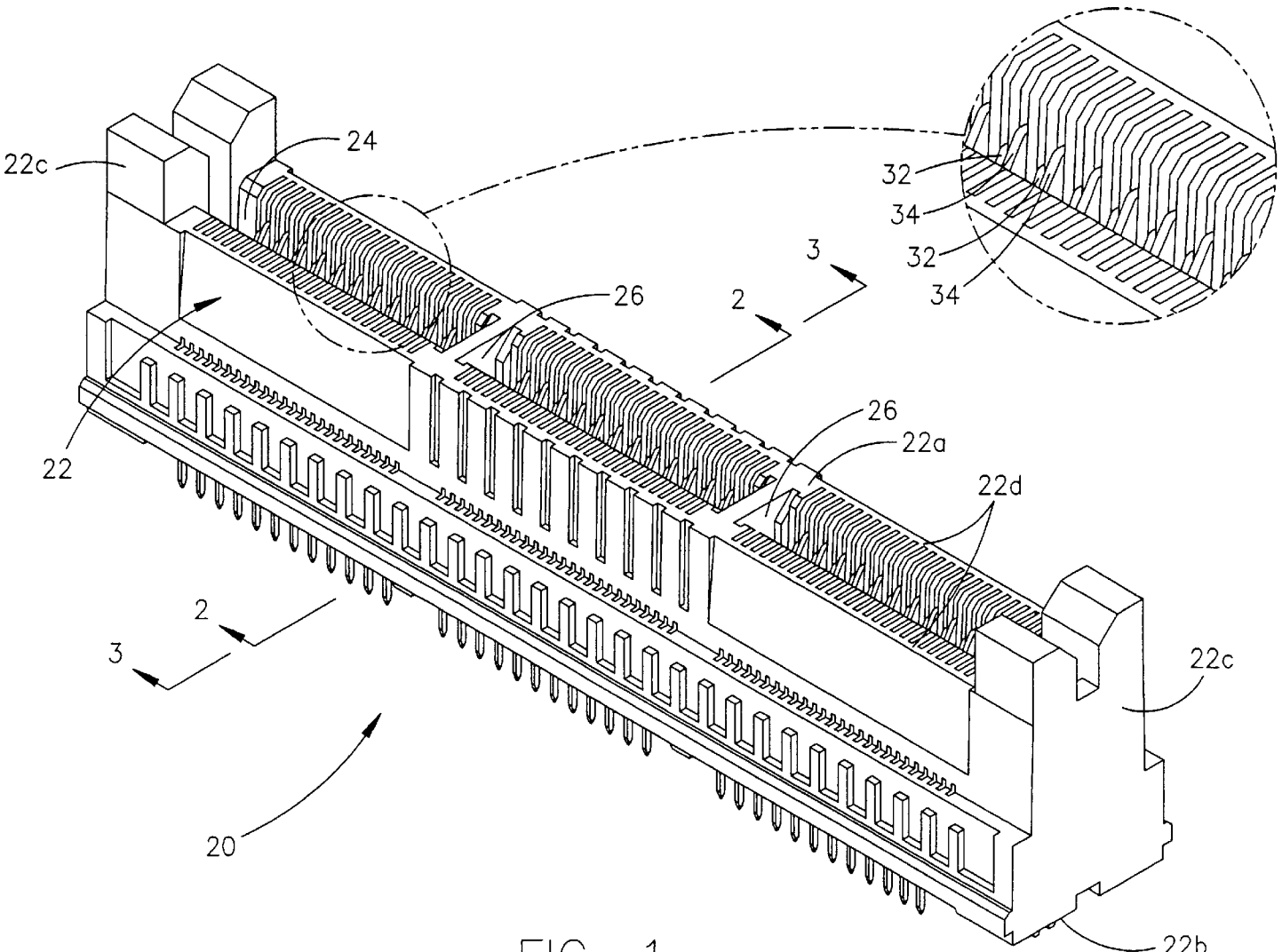
FIG. 1 is a top perspective view of an elongated edge card connector with which the invention is applicable.

Referring to the drawings in greater detail, and first to FIG. 1, the invention is embodied in an elongated electrical connector, generally designated 20, of the edge card type. Nevertheless, the invention could also be embodied in a board to board connector. However, this description will be directed to an edge card connector by way of example. A typical edge card connector includes a unitarily molded dielectric housing, generally designated 22, of plastic material and defining an edge card-receiving face 22*a* and a board-mounting face 22*b*. The edge card-receiving face includes an elongated receptacle or card slot 24 for receiving a mating edge of an edge card having a plurality of contact pads on opposite sides of the card near the edge. A plurality of terminals (described hereinafter) are spaced along both sides of slot 24 for engaging the contact pads adjacent the mating edge on both sides of the edge card. Card slot 24 extends between a pair of uprights 22*c* of housing 22 at opposite ends of the slot. A pair of ribs 26 extend across slot 24 between opposite longitudinal side walls 22*d* of the housing. The ribs are integral with the housing and can provide a dual function of supporting the side walls as well as providing polarizing means for the edge card.

In many applications, edge card connectors, such as connector 20, are mounted on a second printed circuit board, i.e., by board-mounting face 22*b* of connector housing 22. The mating circuit board or edge card often is called the "daughterboard" and the circuit board to which the connector is mounted often is called the "motherboard".

It should be understood that the use of such terms as "top", "bottom", "upwardly", "downwardly", and the like are used herein to provide a clear and concise understanding of the invention in reference to the orientation of the connector and terminals in the drawings. However, these terms are not intended in any way to be limiting, because the connector obviously is usable in all kinds of omni-directional applications.

Figure 3:
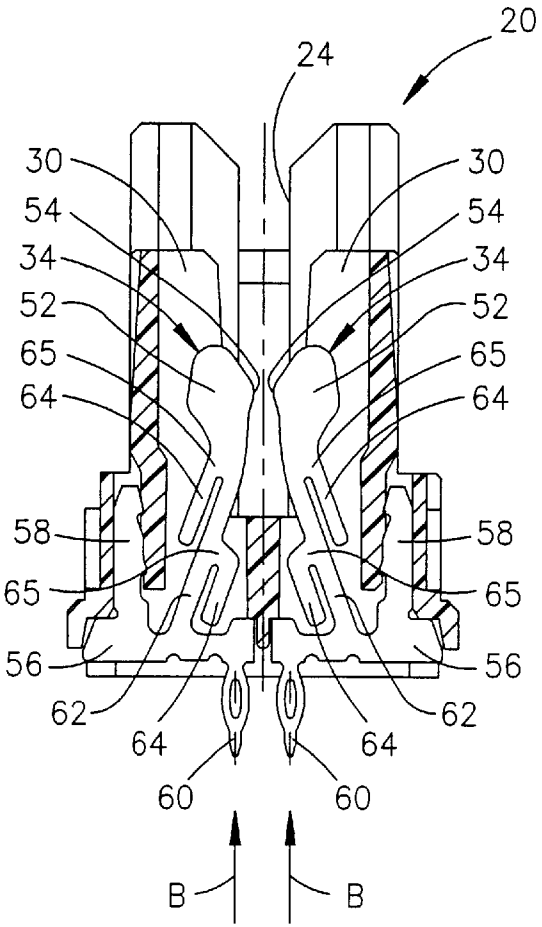
FIG. 3 is a vertical section taken generally along line 3—3 of FIG. 1.
Figure 2:
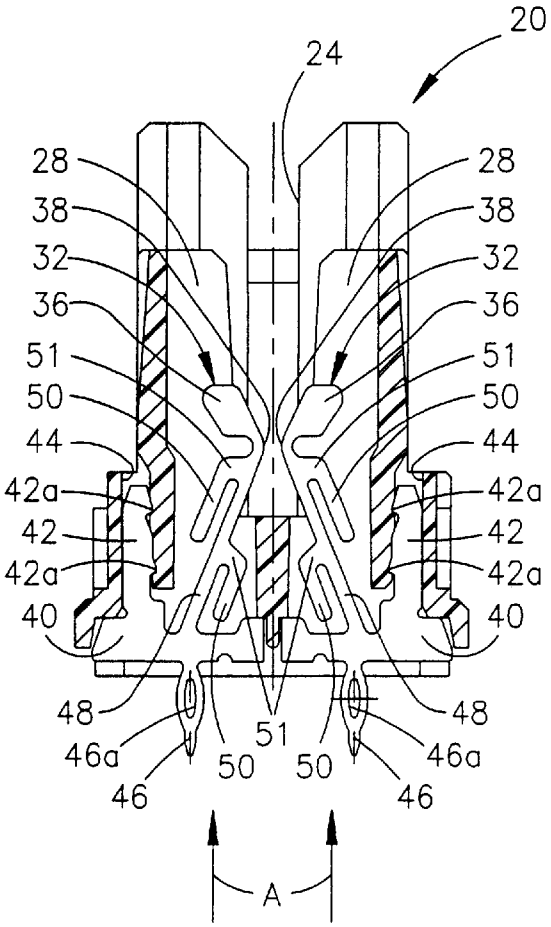
FIG. 2 is a vertical section taken generally along line 2—2 of FIG. 1.

Referring to FIGS. 2 and 3 in conjunction with FIG. 1, a plurality of signal terminal-receiving cavities 28 (FIG. 2) alternate longitudinally of elongated card-receiving slot 24 with a plurality of ground terminal-receiving cavities 30 (FIG. 3). It can be seen that cavities 28 or 30 are in pairs with cavities in each pair being opposite each other directly across slot 24. A pair of signal terminals, generally designated 32, are inserted into each pair of cavities 28 in the direction of arrows "A" (FIG. 2). A pair of ground terminals, generally designated 34, are inserted into each pair of ground terminal-receiving cavities 30 in the direction of arrows "B" (FIG. 3). In other words, one pair of ground terminals 34 is disposed between adjacent pairs of signal terminals 32 alternatingly along the length of slot 24.

Referring specifically to FIG. 2, the signal terminals are mirror images of each other on opposite sides of slot 24, in each pair thereof. Each signal terminal 32 is a planar structure stamped or blanked from conductive sheet metal material. Each terminal includes a contact section 36 extending into slot 24 to a contact point 38 for engaging a respective contact pad on the circuit card inserted into the slot. An enlarged body section 40 has a retention section or post 42 extending upwardly therefrom into a retention cavity 44 in the housing. The retention post includes teeth 42*a* for skiving into the plastic material of the housing within retention cavity 44 to retain the terminal in the housing. A tail section 46 extends downwardly from body section 40 for insertion into an appropriate hole in a printed circuit board ("motherboard") and for connection, as by soldering, to a signal circuit trace on the board and/or in the hole. As shown herein, tail sections 46 are compliant tails which are widened about an aperture 46*a* to provide for yielding of the tail sections when inserted into the holes in the printed circuit board. Of course, straight non-compliant tail sections are contemplated, as well as tail sections which are surface mounted to the printed circuit board rather than being inserted into holes in the board.

Figure 4:
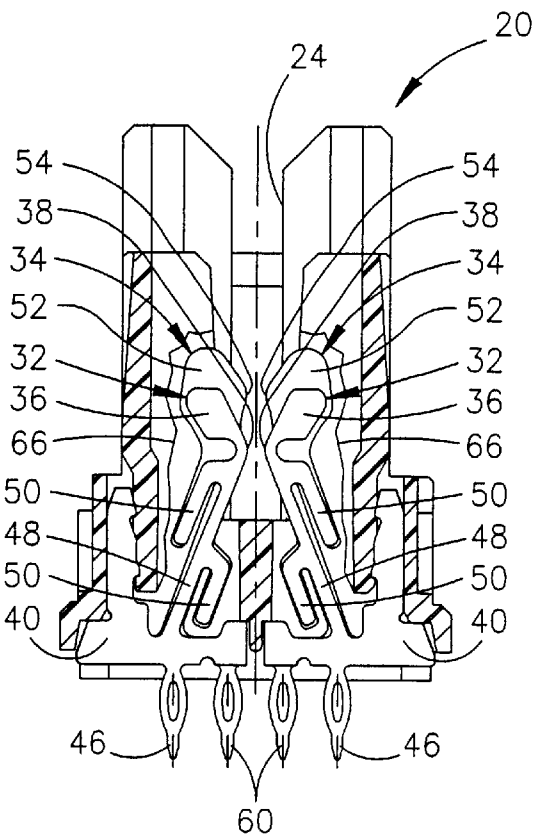
FIG. 4 is a fragmented section showing the shadowing of the signal and ground terminals.

Still referring to FIG. 2, each signal terminal 32 includes a thin flexible contact arm 48 which extends between body section 40 and contact section 36. The thin flexible contact arm angles upwardly and inwardly to contact point 38 of the terminal, as shown. At least one finger portion 50 extends alongside the thin flexible contact arm 48. In the embodiment of FIGS. 2–4, one of the finger portions 50 is disposed on each of two opposite sides of thin flexible contact arm 48. The finger portions are cantilevered alongside the contact arm from bases 51 of the finger portions integral with the contact arm.

Referring to FIG. 3, each ground terminal 34 is structured to face or "shadow" the signal terminals on the same side of slot 34. In other words, each ground terminal 34 includes a contact section 52 defining a contact point 54 extending into slot 24, an enlarged body section 56, a retention section 58, a tail section 60, a thin flexible contact arm 62 and a pair of finger portions 64 extending from a base portion 65, all configured similar to one of the signal terminals 32. Therefore, the partitions between pairs of signal terminal-receiving cavities 28 and ground terminal-receiving cavities 30 have been broken away in FIG. 4, as at 66, to reveal that ground terminals 34 shadow signal terminals 32 lengthwise along card-receiving slot 24, except for the contact points 38 and 54 of the signal and ground terminals, respectively. In fact, it can be seen that the ground terminals are slightly larger than the signal terminals to ensure that the ground terminals shield the signal terminals lengthwise of the connector.

It has been found that one or more finger portions 50, 64 alongside thin flexible contact arms 48, 62 are effective structures for increasing the capacitance of the terminals and, thereby, reduce the impedance of the circuit through the terminal. The finger portion 50 alongside the contact arm 48 of signal terminal 32 capacitively couples to the finger portions 64 alongside contact arms 62 of the adjacent ground terminals 34. Specifically, looking at the structure of each terminal 32, 34, it can be understood that the current path through the terminal is most dense or concentrated in the contact arms. Therefore, finger portions 50, 64 are disposed alongside the most concentrated current path through the terminal. This location of the finger portions alongside the contact arms will have a more profound change on the terminal characteristics than if the finger portions were formed at other locations of the terminal. In other words, finger portions 50, 64 alongside the concentrated current path can increase the capacitance of the terminal more than if the finger portions or other appendages were located somewhere else removed from the current path. Conversely, the finger portions alongside the concentrated current path can be made smaller than other appendages located at other positions remote from the path and still have the same effect.

Figure 7:
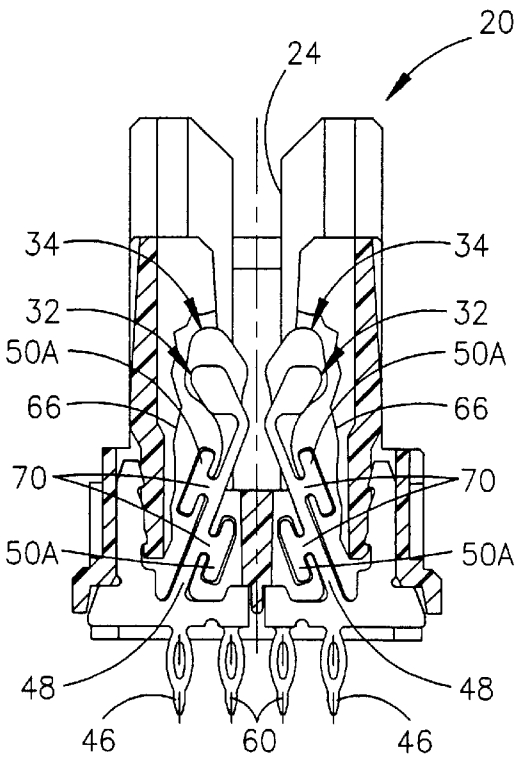
FIGS. 5–7 are views similar to that of FIGS. 2–4, but of an alternate embodiment of the invention.
Figure 6:
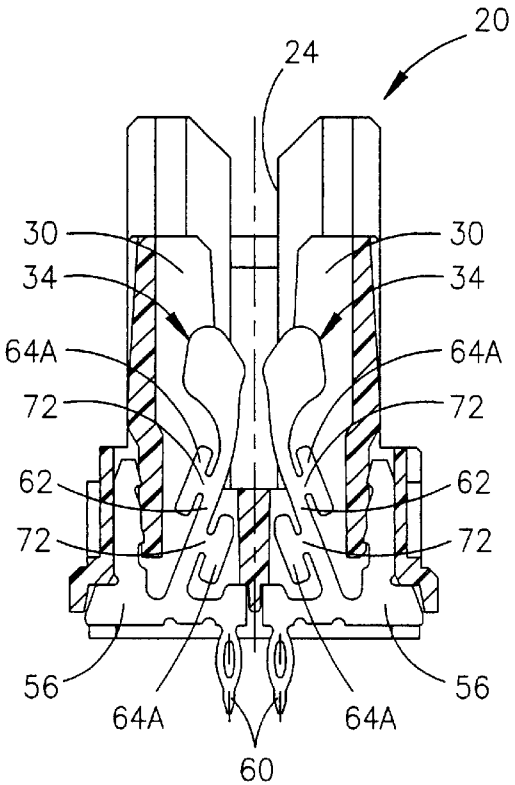
Figure 5:
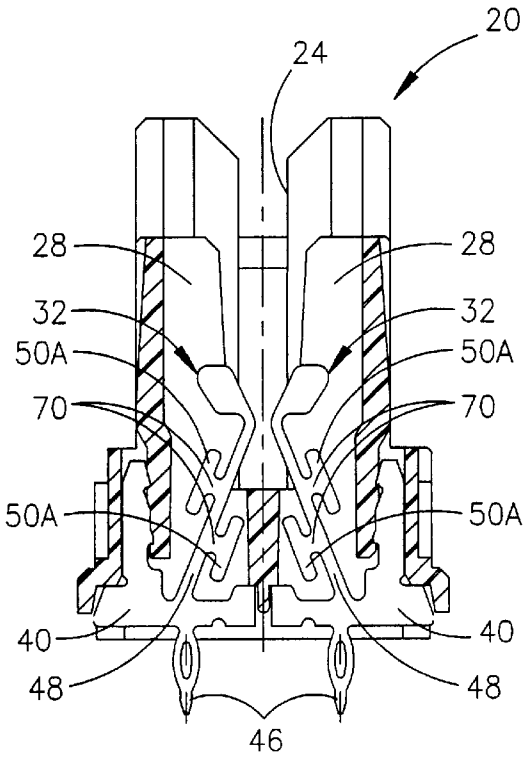

FIGS. 5–7 show another embodiment of the invention and like numerals have been applied in FIGS. 5–7 corresponding to like components described above in relation to FIGS. 2–4. Specifically, the major difference is that signal terminals 32 and ground terminals 34 have differently configured finger portions 50A and 64A, respectively. Whereas fingers portions 50 and 64 in FIGS. 2 and 3, respectively, are cantilevered alongside contact arms 48 and 62, respectively, from bases of the finger portions, fingers 50A and 64A in FIGS. 5–7 are integral with contact arms 48 and 62, respectively, at points intermediate opposite ends of the finger portions. In other words, FIG. 5 shows finger portions 50A integral with contact arm 48 at bases 70 such that the finger portions extend alongside the contact arm in opposite directions from bases 70. Similarly, FIG. 6 shows that finger portions 64A of ground terminals 34 are integral with contact arms 62 at bases 72 intermediate opposite ends of the finger portions.

Figure 10:
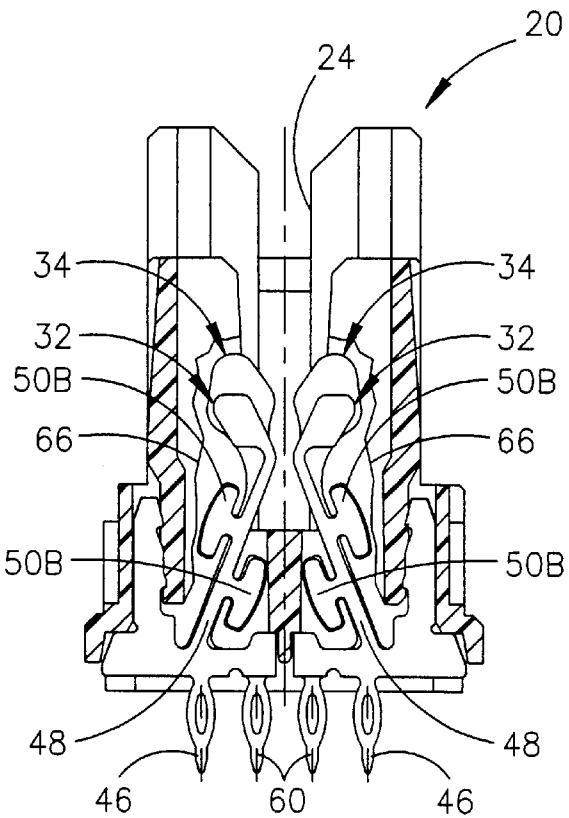
FIGS. 8–10 are views similar to that of FIGS. 2–4, but of a further embodiment of the invention.
Figure 9:
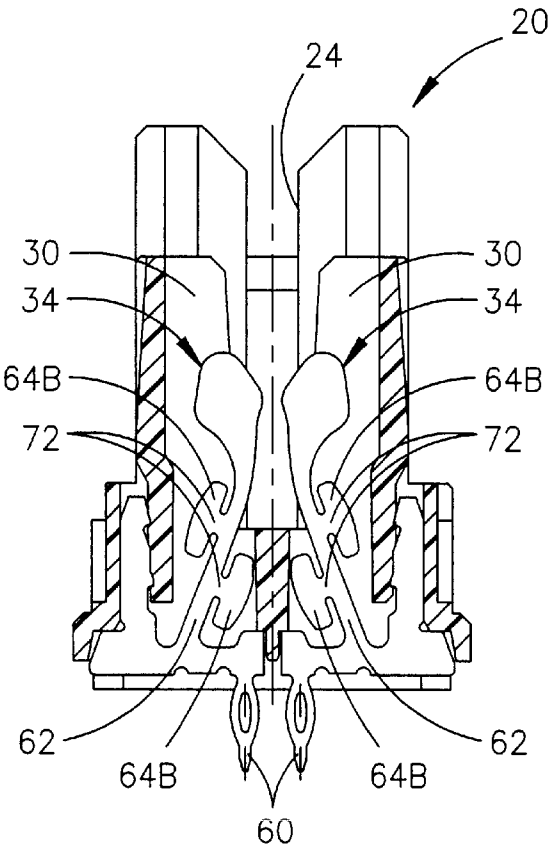
Figure 8:
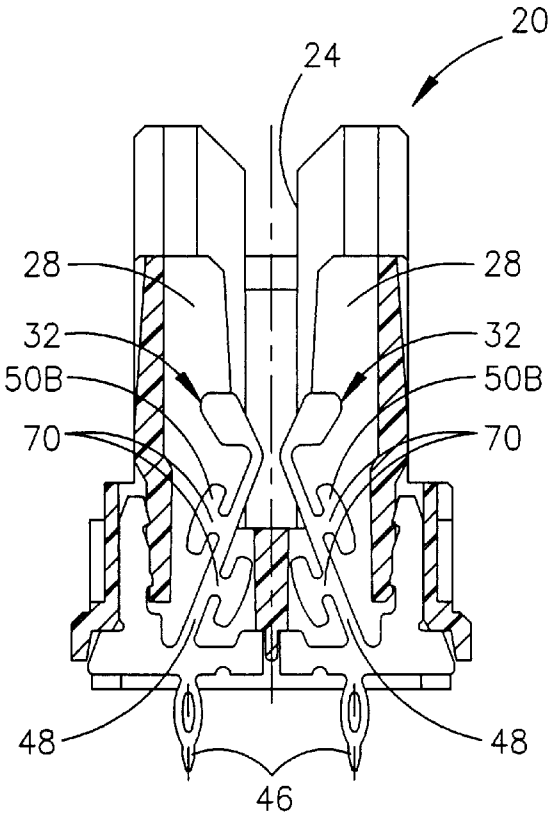

FIGS. 8–10 show a further embodiment of the invention which is very similar to the embodiment of FIGS. 5–7. Again, like reference numerals are applied in FIGS. 8–10 corresponding to like components described above in relation to FIGS. 1–7. In the embodiment of FIGS. 8–10, finger portions 50B and 64B of signal terminals 32 and ground terminals 34, respectively, are very similar to finger portions 50A and 64A, respectively, shown in the embodiment of FIGS. 5–7. In other words, finger portions 50B and 64B are integral with contact arms 48 and 62, respectively, by bases 70 and 72, respectively, intermediate opposite ends of the finger portions. The embodiment of FIGS. 8–10 simply shows that the size of the finger portions, whether they be like the embodiment of FIGS. 2–4 or whether they be like the embodiment of FIGS. 5–10, can be varied or increased to further increase the capacitance of the terminals and, thereby, further reduce the impedance of the circuit through the terminals.

Figure 13:
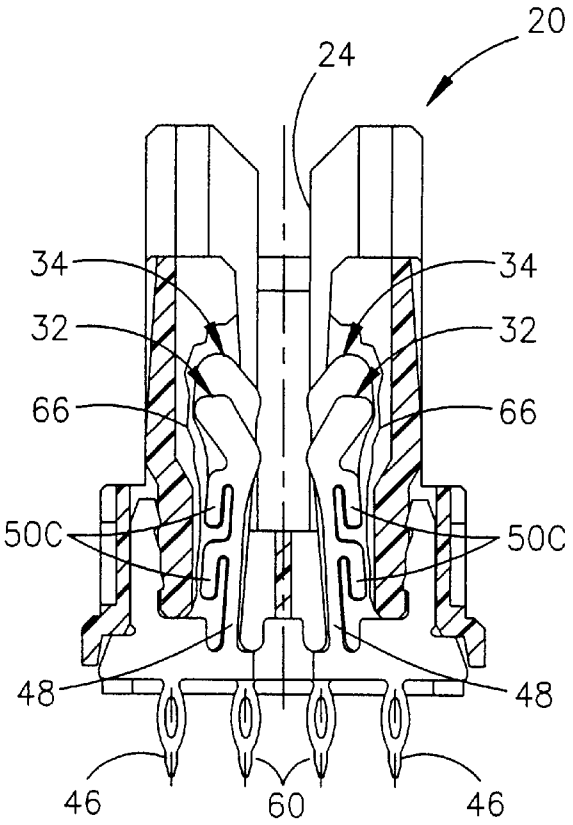
FIGS. 11–13 are views similar to that of FIGS. 2–4, but of still another embodiment of the invention.
Figure 12:
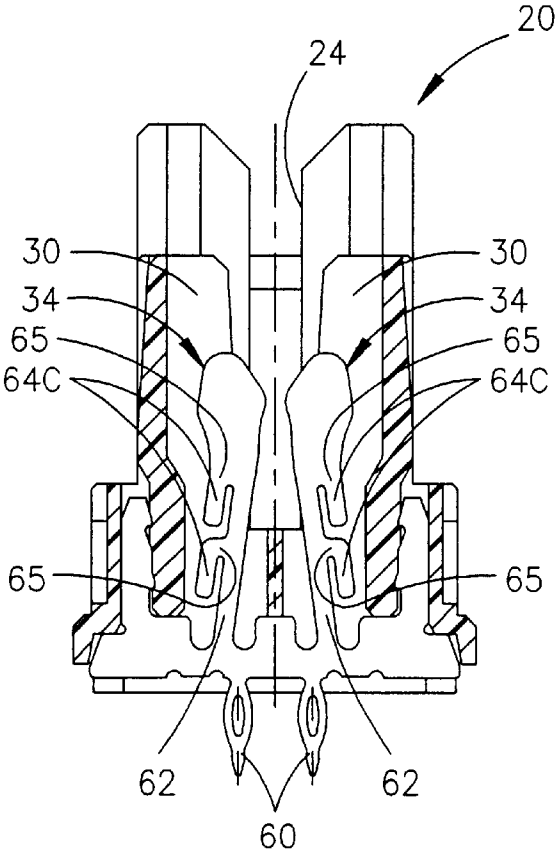
Figure 11:
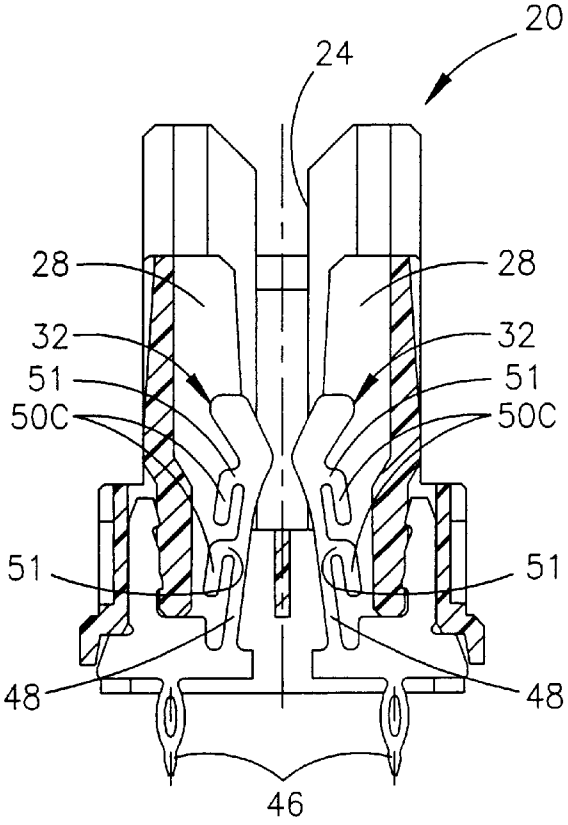

Finally, FIGS. 11–13 show still another embodiment of the invention wherein finger portions 50C of signal terminals 32 and finger portions 64C of ground terminals 34 are again cantilevered alongside contact arms 48 and 62, respectively, of the terminals. The difference between the embodiment of FIGS. 11–13 and the embodiment of FIGS. 2–4 is that the finger portions in the embodiment of FIGS. 2–4 are disposed on both opposite lateral sides of contact arms 48 and 62, respectively. On the other hand, finger portions 50C and 64C of signal terminals 32 and 34, respectively, all are on one side of contact arms 48 and 62, respectively, in the embodiment of FIGS. 11–13.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A connector for use with a circuit component having an insertion portion and a plurality of contacts near the insertion portion, comprising:

a housing including a recess for receiving said insertion portion of the circuit component therein and a plurality of terminal cavities disposed therein adjacent to said recess; and, a plurality of terminals disposed in said terminal cavities, at least some of said terminals each including a contact section extending into said recess for engaging a contact on the circuit component, an enlarged body section, a thin flexible contact arm extending between the body section and the contact section, and a finger portion extending alongside the thin flexible contact arm to increase the capacitance of the terminal and, thereby, reduce the impedance of the circuit through said terminal, said plurality of terminals including signal terminals which alternate along said slot with a plurality of ground terminals which also include finger portions facing said finger portions of said signal terminals longitudinally of said slot.

2. An edge card connector for providing a connection between a circuit card and a circuit board, the circuit card having an insertion edge and a plurality of contact pads disposed on at least one surface of the circuit card proximate to the insertion edge, comprising:

an elongated, electrically insulative connector housing including a slot formed therein and extending lengthwise of the connector housing between two opposite ends thereof, the slot receiving said circuit card insertion edge therein when said circuit card is inserted into said connector housing, said connector housing further including a plurality of terminal-receiving cavities disposed therein proximate to said slot; and, a plurality of conductive terminals, a single terminal being received within a single one of the terminal-receiving cavities, at least one of said terminals having means associated therewith for controlling impedance of said one terminal, said one terminal including a retention portion for mounting said one terminal in said connector housing, a tail portion for connecting to said circuit board, the tail portion extending out of said connector housing, a body portion interconnecting said retention and tail portions together, and a contact arm spaced apart from said retention portion and extending in a cantilevered fashion upwardly from said body portion, the contact arm terminating in a contact portion that extends into said connector housing card-receiving slot for contacting an opposing contact pad of said circuit card when said circuit card is inserted into said connector housing card-receiving slot, the terminal impedance controlling means including a first finger portion formed integrally with said contact arm that extends alongside said contact arm between said terminal contact and body portions.

3. The edge card connector of claim 2, further including a second finger portion formed integrally with said contact arm that extends away from and alongside said contact arm between said terminal contact and body portions.

4. The edge card connector of claim 3, wherein said first and second finger portions are disposed on opposite sides of said contact arm .

5. The edge card connector of claim 2, wherein said first finger portion extends from said contact portion alongside said contact arm.

6. The edge card connector of claim 2, wherein said one terminal is a signal terminal and said plurality of terminals further includes at least one ground terminal having means associated therewith for controlling impedance of said one terminal, said one ground terminal including a retention portion for mounting said one terminal in said connector housing, a tail portion for connecting to said circuit board, the tail portion extending out of said connector housing, a body portion interconnecting said retention and tail portions together, and a contact arm spaced apart from said retention portion and extending in a cantilevered fashion upwardly from said body portion, the contact arm terminating in a contact portion that extends into said connector housing card-receiving slot for contacting an opposing contact pad of said circuit card when said circuit card is inserted into said connector housing card-receiving slot, the ground terminal impedance controlling means including a first finger portion formed integrally with said contact arm that extends and alongside said contact arm between said one ground terminal contact and body portions.

7. An edge card connector for use with a circuit card having an edge and a plurality of contact pads near the edge, comprising:

a housing including an elongated slot for receiving said edge of the circuit card therein and terminal cavities adjacent to said slot; and a plurality of terminals disposed in said terminal cavities, at least some of said terminals each including a contact section extending into said slot for engaging a contact pad on the circuit card, a body section, a thin flexible contact arm extending between the body section and the contact section, and a finger portion extending alongside the thin flexible contact arm to increase the capacitance of the terminal and, thereby, reduce the impedance of the circuit through the terminal, at least one of said terminals having finger portions disposed on each of two opposite sides of said thin flexible contact arm.

8. The edge card connector of claim 1, wherein said finger portions are cantilevered alongside said thin flexible contact arm from bases of said finger portions integral with said terminal contact section.

9. The edge card connector of claim 1, wherein said finger portions are integral with said thin flexible contact arm at points intermediate opposite ends of said finger portions, whereby said finger portions extend alongside said contact arm in opposite directions from those points.

10. The edge card connector of claim 1, including a plurality of said finger portions disposed on one side of said thin flexible contact arm.

11. The edge card connector of claim 1, wherein each terminal includes a retention section projecting from said body section into a retention cavity in said housing.

12. The edge card connector of claim 1, wherein each terminal includes a tail section projecting out of said housing for connection to a printed circuit board.

13. The edge card connector of claims 1, wherein said plurality of terminals include signal terminals which alternate along said slot with a plurality of ground terminals which also include finger portions facing the finger portions of the signal terminals longitudinally of said slot.

14. The edge card connector of claim 1, wherein said finger portions are cantilevered alongside said thin flexible contact arm from a base of said finger portion integral with said thin flexible contact arm.

15. An edge card connector for use with a circuit card having an edge and a plurality of contact pads near the edge, comprising:

a connector housing including an elongated slot for receiving said edge of the circuit card therein and a plurality of terminal cavities disposed therein adjacent to said slot; and, a plurality of terminals disposed in said terminal cavities, at least some of said terminals each including a body section, a contact arm extending from the body section to a contact point projecting into said slot for engaging a contact pad on said circuit card, and a finger portion projecting from the contact arm at a location between the body section and said contact point, said finger portion being integral with said contact arm at a point intermediate opposite ends of said finger portion, whereby said finger portion extends alongside said contact arm in opposite directions from that point.

16. The edge card connector of claim 15 wherein said body section has a lateral width dimension which is greater than that of said contact arm.

17. The edge card connector of claim 15, including at least one of said finger portions disposed on each of two opposite sides of said contact arm.

18. The edge card connector of claim 15, including a plurality of said finger portions disposed on one side of said contact arm.

19. The edge card connector of claim 15, wherein each of said terminals includes a retention section projecting from said body section into a retention cavity in said connector housing.

20. The edge card connector of claim 15, wherein each of said terminals includes a tail section projecting out of said connector housing for connection to a printed circuit board.

21. The edge card connector of claim 5, wherein said plurality of terminals are signal terminals which alternate along said slot with a plurality of ground terminals which also include finger portions facing said finger portions of said signal terminals longitudinally of said slot.

* * * * *